US006984166B2

(12) United States Patent
Maury et al.

(10) Patent No.: US 6,984,166 B2
(45) Date of Patent: Jan. 10, 2006

(54) ZONE POLISHING USING VARIABLE SLURRY SOLID CONTENT

(75) Inventors: Alvaro Maury, Singapore (SG); Jovin Lim, S'pore (SG); Nace Layadi, Singapore (SG); Sebastian Quek, Singapore (SG)

(73) Assignee: Chartered Semiconductor Manufacturing Ltd., Singapore (SG)

( * ) Notice: Subject to any disclaimer, the term of this patent is extended or adjusted under 35 U.S.C. 154(b) by 32 days.

(21) Appl. No.: 10/633,131

(22) Filed: Aug. 1, 2003

(65) Prior Publication Data

US 2005/0026549 A1 Feb. 3, 2005

(51) Int. Cl.
*B24B 1/00* (2006.01)

(52) U.S. Cl. ..... 451/41; 451/60; 451/285; 451/444

(58) Field of Classification Search ..... 451/41, 451/60, 285–289, 446
See application file for complete search history.

(56) References Cited

U.S. PATENT DOCUMENTS

| | | | | | |
|---|---|---|---|---|---|
| 5,658,185 | A | | 8/1997 | Morgan, III et al. | 451/36 |
| 6,059,920 | A | * | 5/2000 | Nojo et al. | 156/345.12 |
| 6,106,728 | A | | 8/2000 | Iida et al. | 210/743 |
| 6,165,048 | A | * | 12/2000 | Russ et al. | 451/5 |
| 6,183,352 | B1 | * | 2/2001 | Kurisawa | 451/87 |
| 6,234,877 | B1 | | 5/2001 | Koos et al. | 451/41 |
| 6,257,965 | B1 | * | 7/2001 | Kamikubo et al. | 451/60 |
| 6,287,192 | B1 | * | 9/2001 | Kim et al. | 451/60 |
| 6,293,849 | B1 | * | 9/2001 | Kawashima | 451/41 |
| 6,398,627 | B1 | * | 6/2002 | Chiou et al. | 451/72 |
| 6,429,131 | B2 | * | 8/2002 | Lin et al. | 438/691 |
| 6,506,098 | B1 | * | 1/2003 | Ho et al. | 451/36 |
| 6,626,741 | B2 | * | 9/2003 | Wang et al. | 451/41 |
| 6,629,881 | B1 | * | 10/2003 | Redeker et al. | 451/60 |
| 6,648,734 | B2 | * | 11/2003 | Chin et al. | 451/41 |
| 6,656,015 | B2 | * | 12/2003 | Mayes | 451/5 |
| 6,669,538 | B2 | * | 12/2003 | Li et al. | 451/56 |
| 6,679,765 | B2 | * | 1/2004 | Tung et al. | 451/60 |
| 6,685,796 | B1 | * | 2/2004 | Lin et al. | 451/60 |
| 6,705,928 | B1 | * | 3/2004 | Barns | 451/60 |
| 6,722,943 | B2 | * | 4/2004 | Joslyn | 451/5 |
| 6,739,953 | B1 | * | 5/2004 | Berman et al. | 451/41 |

* cited by examiner

*Primary Examiner*—M. Rachuba
(74) *Attorney, Agent, or Firm*—George O. Saile; Rosemary L. S. Pike; Stephen B. Ackerman

(57) ABSTRACT

A slurry dispensing apparatus for use with a chemical mechanical polishing tool for planarizing semiconductor substrates having irregular topology. The apparatus includes a slurry dispensing manifold with a first end suspended over a polishing pad, and a second end for mounting to the chemical mechanical polishing tool. The slurry dispensing manifold has a linear array of nozzles positioned under the suspended manifold. Each nozzle provides an adjusted slurry mixture that is supplied from bifurcated supply lines. A first branch supplying a slurry, and a second branch supplying deionized water. Each nozzle is capable of providing a particular slurry concentration to either decrease or to increase polishing rate in specific zonal areas on a substrate according to its surface topology.

17 Claims, 3 Drawing Sheets

FIG. 1 – Prior Art

ZONE POLISHING USING VARIABLE SLURRY SOLID CONTENT

BACKGROUND OF THE INVENTION (1) Technical Field

This invention relates to a method which varies the slurry solid content dispensed on a polishing pad for controlling the polishing rate for specific areas on a semiconductor wafer during planarizing and permits more accurate control of the polishing rate across the semiconductor surface while performing planarizing to produce a uniform substrate surface.

(2) Description of the Prior Art

The following documents relate to a method for controlling a polishing rate across a substrate surface when performing planarization.

U.S. Pat. No. 6,398,627B1 issued Jun. 4, 2002 to Chiou et al. describes a slurry dispenser having multiple adjustable nozzles.

U.S. Pat. No. 6,234,877B1 issued May 22, 2001 to Koos et al. shows a CMP tool with adjacent slurry and diluting solution dispensers.

U.S. Pat. No. 6,106,728 issued Aug. 22, 2000 to Iida et al. shows a CMP apparatus.

U.S. Pat. No. 5,658,185 issued Aug. 19, 1997 to Morgan III et al. shows another CMP apparatus.

The manufacture of an integrated circuit device requires the formation of various layers (both conductive and non-conductive) above a substrate to form the necessary components and interconnects. During the manufacturing process, certain layers or portions of layers must be removed in order to pattern and form the various components and interconnects. Chemical mechanical polishing (CMP) is the method of choice for planarization of a surface of a semiconductor wafer, such as a silicon wafer, at various stages of the integrated circuit processing. CMP is also used to flatten optical surfaces; metrology samples and in various metal and semiconductor based substrates.

CMP is a technique in which chemical slurry is used in conjunction with a mechanical polishing pad to polish away materials on a semiconductor wafer. The mechanical movement of the pad relative to the wafer (and in conjunction with the slurry) provides the abrasive force to polish the exposed surface of the wafer. In the most common form of CMP, a substrate is mounted on a polishing head, which rotates against a polishing pad placed on a rotating table. The mechanical force derives from the rotating table speed and the downward pressure on the head. The chemical slurry is constantly transferred under the polishing head. Rotation of the polishing head helps in the slurry delivery as well as in averaging the polishing rates across the substrate surface. A constant problem of CMP is that the polishing rate varies from the periphery to the center of the wafer for various reasons. Pad bounce is one reason. Variations in the velocity encountered in the rotational movement is another. Some amount of averaging is achieved by rotating the wafer but variations still result in non-uniform polishing across the wafer surface. It is an important goal in the CMP processing to try to minimize this inequality in polishing rates.

This invention is concerned with improving the difference in thickness between center and edge on a wafer. Many of the oxides that are deposited by plasma enhanced methods, and used for inter-metal dielectric are consistently thicker at the substrate edge. The topographical variation from center to edge presents a problem that necessitates improvement to these additive processes. The variation can be as high as one thousand angstroms. This difference imparts a challenge for oxide CMP to polish faster at the edge and slower at the center, so that post-CMP thickness uniformity is acceptable. A uniform film thickness across the wafer after oxide CMP is needed to achieve good printing of small features across the wafer, and it will prevent yield loss issues such as missing vias of metal shorts.

The fabrication of integrated circuits on a semiconductor substrate involves a number of steps where patterns are transferred from photolithographic photo masks onto the substrate. Integrated circuits are typically formed on the substrates by the sequential deposition of conductive, semi conductive or insulative layers. Discriminating etching of the layers assisted by photolithography creates specific structures and devices. Precise focusing for high-resolution photolithographic exposure yields well defined and highly integrated circuit structures.

During the forming of these well-defined integrated circuit structures, it has become increasingly important to construct line widths measuring in the sub micron and nanomicron ranges. The photolithographic processing steps opens selected areas to be exposed on the substrate for subsequent processes such as oxidation, etching, metal deposition, and the like, providing continuing miniaturization of circuit structures. Each of the metal layers is typically separated from another metal layer by an insulation layer, such as an oxide layer. Therefore, there is a need to polish the substrate's constructed surface to provide a planar reference. Planarization effectively polishes away non-planar entities. To enhance the quality of an overlying layer, one without discontinuities of other blemishes, it is imperative to provide an underlying surface for the structured layer that is free of scratches and is ideally planar.

Conventionally, during the fabrication of integrated circuit structures, planarizing of the overlying structured layer is accomplished by CMP. The uniform removal of material from the patterned and non-patterned substrates is critical to substrate process yield. Generally, the substrate to be polished is mounted on a tooling head which holds the substrate using a combination of vacuum suction or other holding methods to contact the rear side of the substrate and a retaining lip or ring around the edge of the substrate to keep the substrate centered on the tooling head. The front side of the substrate, the side to be polished, is then contacted with an abrasive material such as a polishing pad or abrasive strip. The polishing pad or strip may have free abrasive fluid sprayed on it, abrasive particles affixed to it, or may have abrasive particles sprinkled on it.

The ideal substrate polishing method used by most semiconductor foundries is CMP. This choice is based on numerous factors which include; control of relative velocity between a rotating substrate and a rotating polishing pad, the applied pressure between substrate and polishing pad, choosing the polishing pad roughness and elasticity, and a uniform dispersion of abrasive particles in a chemical solution (slurry). In summary, the CMP process should provide a constant cutting velocity over the entire substrate surface, sufficient pad elasticity, and more importantly a controlled supply of clump-free polishing slurry.

A CMP tool of the prior art, shown in simplified form in FIG. 1, illustrates a substrate 78 held by a tooling head 66 which rotates about the central axis of the substrate. A circular polishing pad 60 is rotated while in contact with the bottom surface of the rotating substrate. The rotating substrate contacts the larger rotating polishing pad 60 in an area away from the center of the polishing pad. A slurry dispense nozzle 61 positioned above the surface of the polishing pad dispenses a slurry 63, containing an abrasive and at least one chemically-reactive agent, on the polishing pad 60 by way of a supply circuit, (not shown) and carried to the interface between the polishing pad 60 and substrate. A polishing pad dressing head 67 is pressed downward 69 and oscillates against the top surface of the polishing pad 60 to restore the texture to the polishing pad, thereby, preventing a glaze-like build up of slurry during and after polishing.

The problem with this method of polishing is that many of the oxides deposited on the wafer, by plasma enhanced methods, are thicker at the wafer edge. The thickness variance could measure upwards to 1000 angstroms. This is a continuing process control problem that needs a method of polishing that would quicken the polishing rate at the thicker edge and at the same time slowing the polishing rate towards the center of the wafer.

In view of the above problem, there is a need to improve the method of planarizing when using the CMP process. It is therefore an object of the present invention to provide a slurry dispensing apparatus for a chemical mechanical polishing machine that does not have the drawbacks or shortcomings of the conventional slurry dispensing methods.

It is another object of the present invention to provide a slurry dispensing apparatus for a chemical mechanical polishing machine that is provided with a slurry manifold having a plurality of nozzles each of which would radially distribute different solids to liquid concentrations.

It is yet another object of the present invention to allow a tailoring of the oxide polishing rate across the wafer. Unlike the conventional diaphragm type polishing heads, where zone polishing is not offered due to its fixed physical characteristics.

It is still another object of the present invention to allow the user to have unlimited control of the polishing rate on the wafer from its center to its peripheral edge, therefore, providing better polishing uniformity to the varying topography of the wafer.

SUMMARY OF THE INVENTION

In accordance with the present invention, a slurry dispensing apparatus for a chemical mechanical polishing tool operational with a plurality of nozzles is provided.

A major aspect of the invention is directed to a slurry dispenser apparatus that is used for supplying polishing slurry to a polishing pad in a chemical mechanical polishing tool. The invention is concerned with improving polishing uniformity to a varying topography on a device side of a semiconductor substrate. In a preferred embodiment, a slurry dispenser apparatus that includes a manifold having a linear array of dispensing nozzles thereunder, the manifold is radially mounted in a horizontal position and in close proximity above the rotatable polishing pad. Each nozzle is interconnected to a bifurcated supply of slurry and deionized water. The supply circuit includes adjustable flow meters and check valves connected, in series, to each leg of the bifurcation. The adjustable flow meters control the solid content of the slurry egressing each nozzle, thereto, permitting unlimited control of polishing rate on the wafer from its center area to its periphery.

The present invention is further intended for use with a chemical mechanical polishing (CMP) apparatus for planarizing semiconductor substrates. The CMP apparatus includes a tooling head for holding a substrate therein and for rotating and traversing the substrate on a polishing pad. A polishing table for mounting and rotating a polishing pad mounted thereon, and an oscillating dressing head placed against the top surface of the polishing pad for reconditioning the pile on the polishing pad surface, and a slurry dispenser manifold having a plurality of slurry dispensing nozzles, positioned from the center of the polishing table to the periphery edge of the table.

Since the polishing rate of an oxide film is dependent on the solid content of the slurry, the apparatus and method, of the invention, makes use of this principle to vary the polishing rate at specific areas on the wafer. The plurality of slurry dispense nozzles allows adjustment of solid content in the slurry to be lower at selected annular segments on the polishing pad by mixing and diluting it with DI water. Each nozzle, therefore, is capable of dispensing an adjusted slurry concentration during polishing. The slurry dispensed from each nozzle is supplied to each nozzle pre-mixed by way of a bifurcated path as follows. A first path contains a polishing slurry and a second path containing deionized water. Each path converges to a single path proximal the nozzle. The paths leading to each nozzle begin at a supply source, be it slurry or water, each flowing through a flow meter and check valve. Flow volume is controlled by way of feedback from the flow meters. The desired solid content dispensed at each nozzle is done by way of pressure adjustments at the supply source.

These and further constructional and operational characteristics of the invention will be more evident from the detailed description given hereafter with reference to the figures of the accompanying drawings which illustrate preferred embodiments and alternatives by way of non-limiting examples.

DETAILED DESCRIPTION OF THE PREFERRED EMBODIMENT

There will now be described in detail with reference to the drawings some preferred embodiments of the present invention applied to the slurry dispenser manifold, which is used with a chemical mechanical polishing tool for planarization of a semiconductor substrate.

Figure 1:
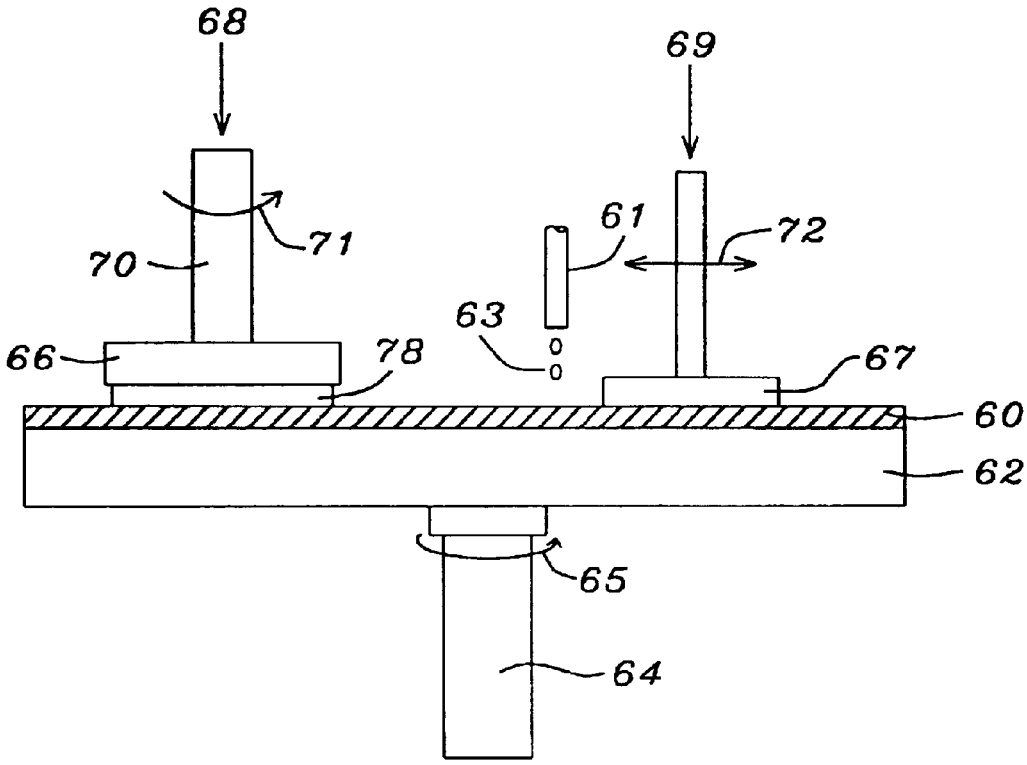
FIG. 1 is a schematic front view of a CMP apparatus showing a slurry dispenser according to the prior art.

Referring to FIG. 1, showing a schematic rendering of a chemical mechanical polishing apparatus of the prior art, a brief review of the CMP apparatus and process follows.

The polishing pad 60, made of a porous material, is attached to the upper surface of a polishing platen 62. The polishing platen is horizontally supported by a platen-rotating shaft 64, and is rotationally driven 65 through the platen-rotating shaft during the polishing operation.

The polishing head assembly 66 having a lower surface opposed to the upper surface of the polishing pad 60. A recess forms a nesting surface and a backing film (not shown) which centers and releasably holds the substrate 78 to be polished. The polishing head assembly is mounted to a shaft 70 and is rotated 71 relative to the rotating platen 62.

The CMP tool polishes the substrate 78, which is positioned face down and in firm contact, under pressure 68, with the rotating polishing pad 60. The substrate is also rotated either about an axis coincident with its own center or offset from its own center, but not coincident with the axis of rotation of the polishing pad 60. The abrasive polishing slurry 63 is sprayed against the pad surface through a single nozzle 61. As a result of the rotating contact and abrasive components in the slurry between the polishing pad 40 and the substrate 78, the substrate's surface becomes planarized after a designated time period. The rate of removal is closely proportional to the pressure 68 applied to the substrate 78 and the dressing of the polishing pad. A dressing head 67 is pressed downward 69 while oscillating 72 against the top surface of the polishing pad to restore the texture to the polishing pad, thereby, preventing a glaze-like build up of slurry during and after polishing. More importantly, however, the uniformity of removal depends upon the topography of the top layer of the substrate 78, as higher features (extending further from the substrate surface) are removed faster than lower features. This invention is concerned with improving polishing uniformity to substrates with varying topography on a device side of a semiconductor substrate.

Figure 2:
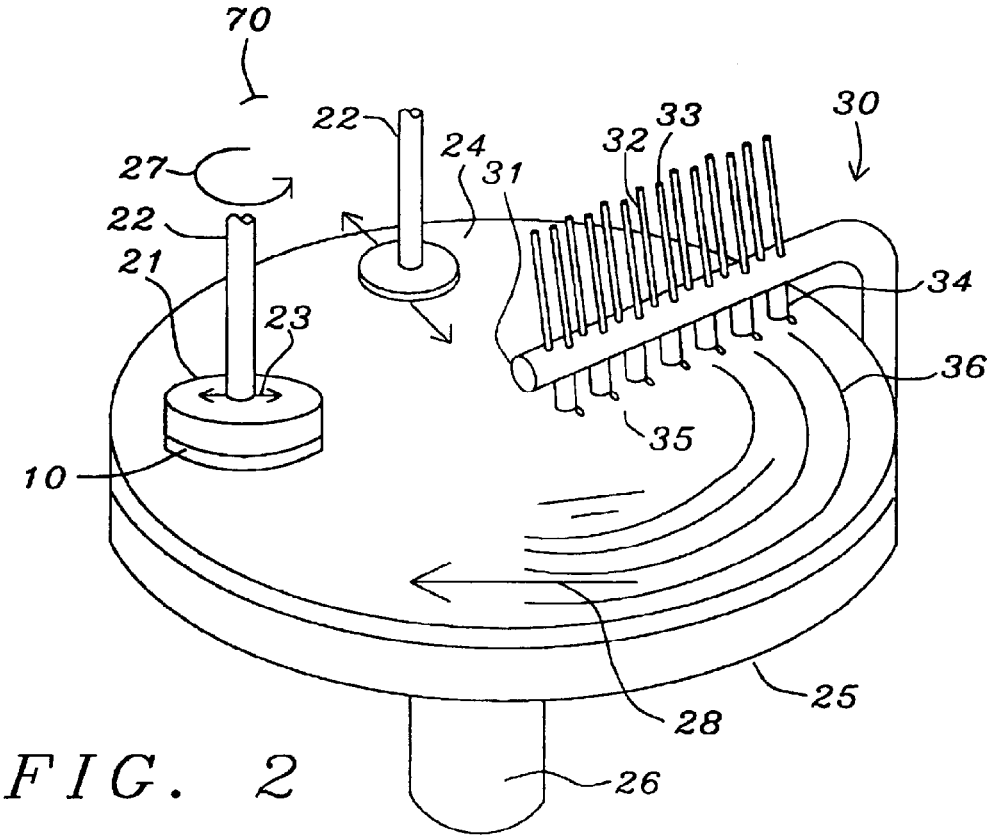
FIG. 2 is a top perspective view of the CMP apparatus showing the slurry dispenser manifold of the invention.

Referring now more specifically to FIG. 2 there is illustrated a top perspective view of the CMP apparatus showing the location of a slurry dispenser manifold 30 relative to a polishing pad 24 of the invention. A semiconductor substrate 10, shown urged against a rotating 28 polishing pad 24, is held by substrate holder 21, rotated 27 and oscillated during polishing. This technique is used for the planarization of an oxide layer deposited by plasma enhanced techniques. The oxide layer is functional as an inter-metal dielectric; however, it deposits a thicker build-up at the substrate edge.

For example, when depositing fluoro-silicate glass, the difference in thickness between the substrate's center area and its edge can be as much as 1000 Å. This difference presents a complication when planarizing a substrate when using the chemical mechanical polishing process. That is, after planarization, a uniform thickness of an oxide layer is required to achieve& quality photolithographic printing of sub-micron features, overall, to prevent yield losses resulting from missing vias or metal shorts.

The apparatus and method of the invention solves this problem. The circular polishing pad 24 is rotated by a polishing table 25 which is coupled to a drive shaft 26 driven by a drive motor (not shown). The substrate holder 21 rotates and oscillates 23 while urging the substrate 10 against the polishing pad during the polishing process. The rotating substrate contacts the larger rotating polishing pad 24 in an area away from the center of the pad. The slurry dispenser manifold 31 is shown positioned above the surface of the polishing pad 24 such that a linear array of nozzles 34 are radially spaced from about the center of the polishing pad to about its outer periphery. The array of nozzles is shown dispensing a slurry 35 thereon, forming circular paths 36 of slurry as the polishing pad rotates thereunder.

Figure 3:
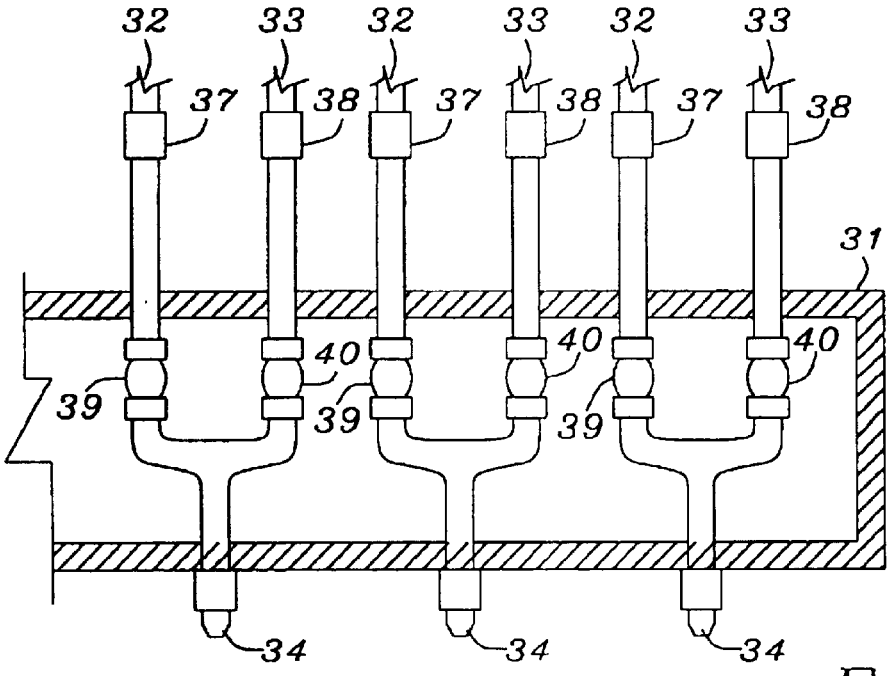
FIG. 3 is an enlarged cross-sectional and fragmented view of a slurry dispenser manifold showing several bifurcated supply circuits and nozzles, of the invention.
Figure 4:
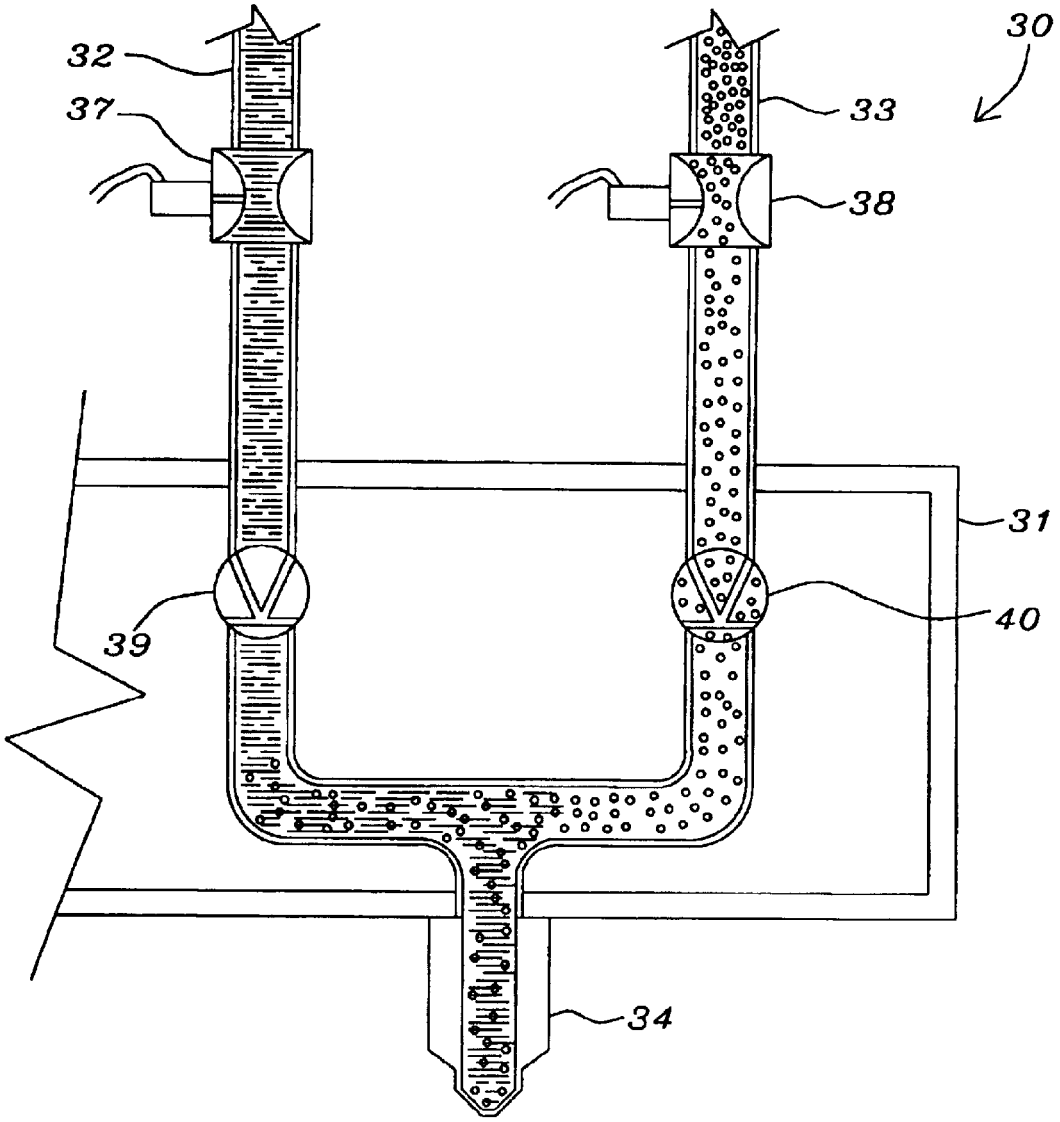
FIG. 4 is a cross-sectional illustration showing the bifurcated slurry and DI water circuits of the invention.

A slurry dispensing apparatus 30 for use with a chemical mechanical polishing tool 70 for planarizing semiconductor substrates 10 having irregular topology is disclosed. The slurry dispensing manifold 31 is shown having a first end suspended over a polishing pad 24, and a second end for mounting to the chemical mechanical polishing tool 70. A linear array of slurry dispensing nozzles 34 positioned under the suspended portion of manifold 31. Each nozzle of the linear array providing an adjusted slurry mixture 35 supplied from bifurcated supply lines 32, 33. Referring now to FIGS. 3 and 4 showing an enlarged view of the bifurcated supply lines 32 and 33. FIG. 3 illustrates a cut-away view of a manifold member 31 showing a linear array of three dispensing nozzles. Bifurcated lines 32 are supplied from a common source (not shown) of deionized water and lines 33 are supplied from a common source (not shown) of a slurry emulsion. The slurry emulsion is a colloidal alumina or silica in deionized water. Each of the supplied materials flow past respective flow meters 37, 38 and respective check valves 39 and 40. This is best illustrated in FIG. 4. The location of the check valves that are mounted before and proximal the junction of the bifurcated supply lines functions as a mixing venturi for the nozzles.

The supplied materials converge as a diluted mix or as undiluted, depending on the adjustment of a flow control valve located at its source. Each nozzle circuit is capable of supplying an adjusted volume of slurry emulsion and an adjusted volume of liquid. The various mixes are dispensed through its respective nozzle 34, each belonging to the linear array. The spacing and number of nozzles is dependent on several factors including the substrate size, polishing resolution, dispensing pattern of nozzles, and material overlap. The benefit of the present invention allows a fine-tuning of the polishing rate on a substrate according to its topography. The variable flow control valve is slaved to an ouput signal given by the flow meter in response to a programmable tool controller.

While the invention has been particularly shown and described with reference to the preferred embodiments thereof, it will be understood by those skilled in the art that various changes in form and details may be made without departing from the spirit and scope of the invention.

What is claimed is:

1. A slurry dispensing apparatus for use with a chemical mechanical polishing tool for planarizing semiconductor substrates having irregular topology, said apparatus comprising:

a slurry dispensing manifold having a first end suspended over a polishing pad, and a second end for mounting to the chemical mechanical polishing tool;

a linear array of slurry dispensing nozzles positioned under said suspended manifold, wherein each nozzle is fed from a bifurcated supply line, and each branch of said bifurcated supply line having an adjustable flow control valve, a flow meter and a check valve.

2. The apparatus of claim 1 wherein said bifurcated supply line conjoined to each nozzle provides an adjusted volume of slurry from one branch and an adjusted volume of liquid from the other branch.

3. The apparatus of claim 1 wherein said adjusted volume of slurry and adjusted volume of liquid provides the means for diluting the dispensed slurry to selected nozzles thereby controlling the polishing rate in specific zones on a substrate according to its topography.

4. The apparatus of claim 1 wherein each of said array of nozzles are identical.

5. The apparatus of claim 1 wherein said slurry and liquid that is supplied to each branch of said bifurcated supply lines are fed from a source container, serially, through a variable flow control valve, a flow meter, and a check valve.

6. The apparatus of claim 5 wherein said variable flow control valve is slaved to an output signal provided by said flow meter in response to a programmable tool controller.

7. The apparatus of claim 5 wherein said check valves mounted proximal junction of said bifurcated supply lines performs as a mixing venturi for said nozzles.

8. The apparatus of claim 5 wherein said slurry is a colloidal alumina or silica prepared with deionized water, and said liquid is deionized water used for diluting said slurry.

9. A method for planarizing semiconductor substrates having irregular topology, comprising the steps of:

providing a chemical mechanical polishing tool;

providing a slurry dispensing manifold having a first end suspended over a polishing pad, and a second end for mounting to the chemical mechanical polishing tool;

providing a linear array of slurry dispensing nozzles positioned under said suspended manifold, each nozzle of said linear array dispensing an adjusted slurry mixture supplied from a bifurcated supply line, while each branch of said bifurcated supply line having an adjustable flow control valve, a flow meter, and a check valve.

10. The method of claim 9, wherein said bifurcated supply lines dispense an adjusted volume of slurry and an adjusted volume of a liquid to each nozzle.

11. The method of claim 9 wherein said adjusted volume of slurry and liquid provide the means for diluting the dispensed slurry through selected nozzles thereby fine-tuning the polishing rate on a substrate according to its topography.

12. The method of claim 9 wherein each of said array of nozzles are identical.

13. The method of claim 9 wherein said slurry and liquid that is supplied to each branch of said bifurcated supply lines are fed, serially, from a source container, to a variable flow control valve, a flow meter, a check valve, a junction, and said nozzle.

14. The method of claim 13 wherein said variable flow control valve is slaved to an output signal provided by said flow meter in response to a programmable tool controller.

15. The method of claim 13 wherein said check valves mounted proximal said junction of said bifurcated supply lines performs as a mixing venturi for said nozzles.

16. The method of claim 13 wherein said slurry is a colloidal alumina or silica in deionized water, and said liquid is deionized water used for dilution.

17. The method of claim 9 wherein said polishing is accomplished in two steps.

i. adjusting the dilution of slurry to each nozzle according to substrate's topology;

ii. normalize flow to each nozzle for polishing uniformity.

* * * * *

UNITED STATES PATENT AND TRADEMARK OFFICE

CERTIFICATE OF CORRECTION

PATENT NO. : 6,984,166 B2
APPLICATION NO. : 10/633131
DATED : January 10, 2006
INVENTOR(S) : Alvaro Maury et al.

It is certified that error appears in the above-identified patent and that said Letters Patent is hereby corrected as shown below:

On the Title page, in item (75), delete second inventor "Jovin Lim, S' pore (SG)" and replace with - - Jovin Lim, Singapore, (SG) - -.

Signed and Sealed this

Fifteenth Day of August, 2006

JON W. DUDAS
*Director of the United States Patent and Trademark Office*